United States Patent [19]

Iwasaki et al.

[11] Patent Number: 5,026,419

[45] Date of Patent: Jun. 25, 1991

[54] MAGNETICALLY ANISOTROPIC HOTWORKED MAGNET AND METHOD OF PRODUCING SAME

[75] Inventors: Katsunori Iwasaki, Kumagaya; Shigeho Tanigawa, Kounosu; Masaaki Tokunaga, Fukaya, all of Japan

[73] Assignee: Hitachi Metals, Ltd., Tokyo, Japan

[21] Appl. No.: 520,653

[22] Filed: Apr. 25, 1990

Related U.S. Application Data

[62] Division of Ser. No. 355,641, May 23, 1989, Pat. No. 4,952,251.

[51] Int. Cl.[5] ..... B22F 1/00

[52] U.S. Cl. ..... 75/254; 252/62.55; 148/101; 148/302; 75/243; 75/244

[58] Field of Search ..... 252/62.55; 75/246, 244, 75/243, 232, 254; 148/101, 302

[56] References Cited

U.S. PATENT DOCUMENTS

| | | | |
|---|---|---|---|
| 4,385,944 | 5/1983 | Hasegawa | 148/104 |
| 4,710,236 | 12/1987 | Schultz | 148/11.5 |
| 4,780,226 | 10/1988 | Sheets et al. | 252/28 |
| 4,915,737 | 4/1990 | Morimoto et al. | 75/246 |

FOREIGN PATENT DOCUMENTS

| | | |
|---|---|---|
| 0133758 | 8/1983 | European Pat. Off. . |
| 0126179 | 11/1984 | European Pat. Off. . |
| 0915219 | 9/1986 | European Pat. Off. . |
| 6134101 | of 1984 | Japan . |
| 60-184602 | 9/1985 | Japan . |
| 6398105 | of 1986 | Japan . |
| 63-232301 | of 1987 | Japan . |

*Primary Examiner*—Stephen J. Lechert, Jr.
*Assistant Examiner*—Nina Bhat
*Attorney, Agent, or Firm*—Finnegan, Henderson, Farabow, Garrett & Dunner

[57] ABSTRACT

Anisotropic hot-worked permanent magnets are made from an R-T-B alloyed powder to which is added a combination internal lubricant including a carbon-based material such as graphite and a glass material such as glass from the $B_2O_3$—$SiO_2$—$BiO_3$ glass system. The internal lubricant provides improved formability during the hot-working step, such as die-upsetting, and provides finished magnet products wherein the individual grains are more uniformly plastically deformed throughout the product.

10 Claims, 6 Drawing Sheets

MAGNETICALLY ANISOTROPIC HOTWORKED MAGNET AND METHOD OF PRODUCING SAME

This is a division of application Ser. No. 07/355,641 now allowed U.S. Pat. No. 4,952,251, filed May 23, 1989.

BACKGROUND OF THE INVENTION

The present invention relates to hot-worked permanent magnets consisting substantially of rare earth elements, transition metals and boron and provided with magnetic anisotropy by hot working, and more particularly to hot-worked magnets having improved crystal grain orientation and thus having good magnetic properties. The present inventions especially relates to a methof of producing such hot-worked magnets without cracking by adding proper amounts of additives as graphite powder and glass material having a low melting point to improve workability.

Permanent magnets consisting essentially of rare earth elements, transition metals and boron (hereinafter referred to as "R-T-B permanent magnets") have been receiving much attention as inexpensive permanent magnets having excellent magnetic properties. This is because intermetallic compounds expressed by $R_2T_{14}B$ having a tetragonal crystal structure have excellent magnetic properties. $Nd_2Fe_{14}B$, in which Nd is employed as R, has lattice parameters of $a_0=0.878$ nm and $c_0=1.219$ nm.

The R-T-B permanent magnets are usually classified into two groups: sintered magnets and rapidly quenched magnets. Whichever production method is utilized, it is necessary to form them to desired shapes. In this sense, they should have good workability. In order to improve the workability of the magnets, the addition of lubricating agents has conventionally been conducted. The lubricants are classified into external lubricants which are applied to die surfaces or surfaces of magnet products to be formed to reduce friction between the die surfaces and the magnet products being formed, and internal lubricants which are in the form of powder, liquid, solid, etc. and are added to the magnet products to be formed to reduce friction between the powder particles.

European Patent Laid-Open No. EP 0,133,758 discloses the coating of a die surface with graphite as an external lubricant for hot die-upsetting, to improve the workability of magnets in the hot-working process, thereby obtaining hot-worked magnets free from cracks. The effects of graphite on the inner lubrication of the magnets are not referred to. U.S. Pat. No. 4,780,226 discloses a method of producing a hot-worked magnet wherein there is used a complex additive of graphite and glass material as an external lubricant for hot die-upsetting, to improve the workability of magnets in the hot-working process. In the method, a glass powder material having a melting point which is lower than the hot-working temperature, or a mixture of glass powder and graphite powder is sprayed on the surfaces of punches and dies to form a green body of magnet material.

In the case of sintered magnets, stearic acid is widely used as an internal lubricant (Japanese Patent Laid-Open No. 61-34101). Stearic acid is a saturated aliphatic acid having the formula: $CH_3(CH_2)_{16}COOH$. It is also known to suppress the growth of crystal grains and simultaneously increase the density of the resulting magnet in the sintering step by adding carbon powder or a powder of carbide-forming components such as Ti, Zr, Hf, etc. to form metal carbides (Japanese Patent Laid-Open No. 63-98105).

However, if sintered magnets are to be provided with magnetic anisotropy, a pressing step in a magnetic field must be conducted, limiting the shapes of magnets to be formed. In view of this fact, much attention has been paid to rapidly quenched magnets which do not need to be pressed in a magnetic field, particularly permanent magnets obtained by pulverizing thin ribbons or flakes produced from melts of R-T-B alloys by a rapid quenching method, hot-pressing them (high-temperature treatment) and then subjecting them to plastic working at high temperature to provide them with magnetic anisotropy, which will be called "hot-worked magnets" hereinafter (European Patent Laid-Open No. EP 0,133,758). The individual thin ribbons or flakes produced by such a rapid quenching method usually contain innumerable fine crystal grains. Even though the thin ribbons or flakes produced by rapid quenching are in various planar shapes of 30 μm in thickness and 500 μm or less in length, the crystal grains contained therein are as fine as 0.02–1.0 μm as an average grain size, which is smaller than the average grain size of 1–90 μm in the case of sintered magnets (see, for instance, European Patent Laid-Open No. EP 0,126,179). The average grain size of the rapidly quenched magnets is close to 0.3 μm, the critical size of a single domain of the R-T-B magnet, which means that it provides essentially excellent magnetic properties.

In the case of hot working rapidly quenched magnetic materials, it is important that there is a close relationship between the direction of plastic flow and magnetic orientation perpendicular to the direction of the plastic flow. Further, it is necessary to cause the plastic flow uniformly in the entire magnet to be worked, in order to improve the orientation of the crystal grains which strongly influence the magnetic properties. Incidentally, a nonuniform deformation may cause bulging of the magnets in the plastic working process, which in turn produces large and/or many cracks in the peripheral portions of the magnets. This is a serious problem when hot-worked magnets are to be formed into the shape of final products. Most of the force applied in hot-working is used for plastic deformation, but part of the force is exhausted by friction between the particles. This may be a partial cause of the above bulging phenomenon.

Various types of internal lubricants for hot-worked magnets are known in the art. EP 0,195,219 discloses a rapidly quenched hot-worked permanent magnet of the R-T-B type in which each particle of the powder material used for the preform may be coated with an inorganic or organic lubricant. Examples of suitable lubricants given are graphite and molybdenum disulfide. Japanese Laid-Open No. 60-184,602 discloses the use of polyethylene glycol monolaurate to increase the formability of sintered magnets, and U.S. patent application Ser. No. 07/327,631 (commonly assigned) filed on 3/23/89, now U.S. Pat. No. 4,978,398 discloses the use of various organic compounds as internal lubricants to provide carbon and oxygen in the grain boundaries after the hot-working step.

In the above-mentioned conventional techniques, external lubricants such as graphite and/or glass applied to the die surface for die lubrication to reduce friction between a work body and surfaces of tools (dies and punches) only partly, if at all, attaches to the thin ribbons or flakes produced by a rapid quenching method, which are 30 μm or so in thickness and 500 μm or less in length, much less to the innumerable fine crystal grains inside the thin flakes. Hence, external lubricants do not play a role as an inner lubricant to reduce occurance of cracks in a magnet produced by hot-working.

Incidentally, in the case of adding carbon powder or powder of carbide-forming components such as Ti, Zr, Hf, etc. to sintered magnets, it is expected that such powder is relatively easily dispersed in magnet powder by appropriately selecting a powder shape and a mixing method. The same is true of stearate. This is because in the case of sintered magnets, magnetic powder particles produced by pulverizing alloy ingots are in a shape close to spherical. However, unlike the sintered magnets produced by powder metallurgy method in which compacting is conducted at room temperature, hot-working such as by die-upsetting, is usually conducted at as high a temperature as 600°–850° C. Accordingly, lubricants dispersed among thin flakes show essentially different behavior, and this has not yet been appreciated.

In addition, the conventional techniques in which an external lubricant is applied to a die surface do not show affects peculiar to the hot-working of the magnets, but they simply show effects of lubricants which slightly decrease the friction between the die surface and materials being worked. In fact, there has been no report so far with respect to the improvement of workability without significant cracking and the improvement of uniform orientation, in the field of hot-working rapidly quenched magnet ribbons or flakes.

SUMMARY OF THE INVENTION

Accordingly, an object of the present invention is to provide a hot-worked magnet made of an R-T-B alloy free from cracks and with excellent magnetic characteristics.

Another object of the present invention is to provide a method of producing such a hot-worked magnet.

The magnetically anisotropic hot-worked magnet according to the present invention is made of an R-T-B alloy containing a transition metal T as a main component, rare earth element R including yttrium, and boron B; the magnet having fine crystal grains having an average grain size of 0.02–1.0 μm, and having a carbon content of 0.5 weight % or less and an oxygen content of 0.3 weight % or less.

The method of producing a magnetically anisotropic hot-worked magnet according to the present invention comprises rapidly quenching a melt of an R-T-B alloy containing a transition metal T as a main component, a rare earth element R including yttrium, and boron B to form thin ribbons or flakes; pulverizing the thin ribbons or flakes to form magnetic powder; and subjecting the magnet powder to hot-working to provide the resulting magnet with magnetic anisotropy, characterized in that the magnetic powder is mixed with an additive composed of at least one glass material having a low melting point and graphite powder and is hot-worked at a temperature of 600°–850° C.

BRIEF DESCRIPTION OF THE DRAWINGS

FIG. 6 presents comparative photomicrographs of hot-worked magnets showing fracture planes observed in a direction perpendicular to the compression direction; and FIG. 7 presents comparative photomicrographs of hot-worked magnets showing fracture planes observed in a direction parallel to the compression direction.

DESCRIPTION OF THE PREFERRED EMBODIMENTS

Figure 1:
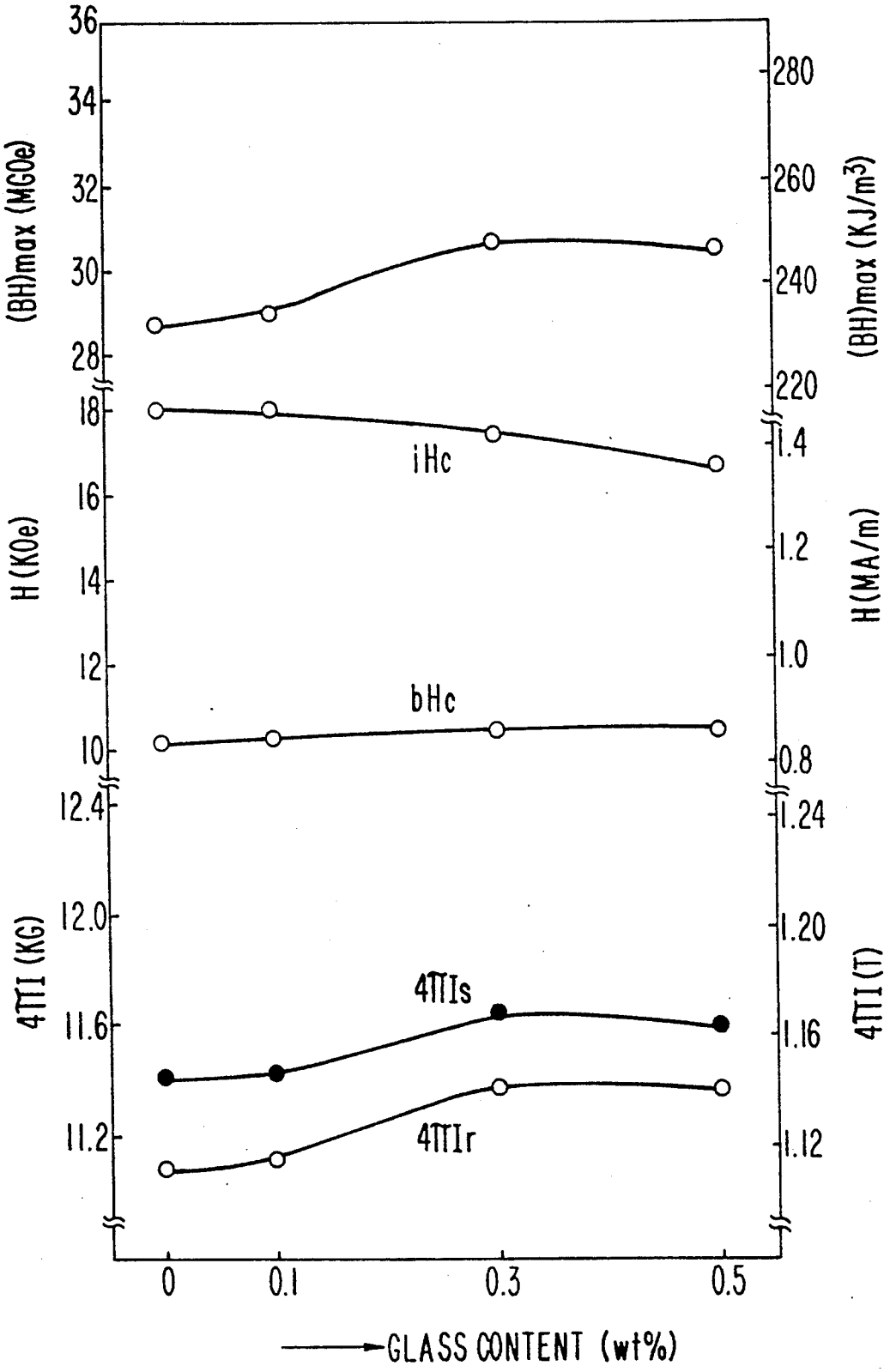
FIG. 1 shows magnetic properties such as $4\pi I$, iHc and (BH)max of a hot-worked magnet depending on the amount of glass added as an internal lubricant.

Magnets provided with improved magnetic properties compared with conventional hot-worked magnets can be produced as explained below according to the method of the present invention.

The present invention is for example a hot-worked permanent magnet having fine crystal grains with an average grain size of 0.02–1.0 μm, which comprises a metal T as a main component, a rare earth element R which can include yttrium, and B; the magnet is produced by the steps of;

(a) rapidly quenching a melt of an R-T-B to form thin ribbon or flakes, (b) pulverizing the thin ribbons or flakes to form magnetic powder, (c) mixing the magnetic powder with at least two additives including a carbon-based material and a glass material, and (d) subjecting the mixed magnet powder to hot-working to provide the magnet with magnetic anisotropy, characterized in that the magnet has a carbon content of 0.5 wt % or less, and an oxygen content of 0.3 wt % or less. Preferably the material is a low melting point glass.

In the present invention the low melting point glass can be a water glass, a $PbO$-$B_2O_3$-$SiO_2$ type of glass, or a glass called Deltaglaze (Trade Name) conventionally used in casting processes for Ti metal or extrusion processes for Ti metal at room temperature. The Deltaglaze (Trade Name) is applied in a powder form together with trichloroethylene.

In the following discussion, the role of the additive glass is explained. Often, many spherical shapes or lumps having a black color can be observed in a magnet containing the single internal lubricant additive graphite. Although it is difficult to confirm that all the black lumps are flakes or agglomerates of graphite rich material, the lumps increase and tend to be larger as the graphite content added to the magnet increases. This means that graphite rich material powder can become locally concentrated in the magnet without a glass additive.

On the contrary such lumps have not been observed in magnets having a second additive added in combination, namely a glass material additive, even with the same amount of graphite. It is assumed that the glass material softened by heat during the hotworking process contributes to disperse the added graphite powder uniformly in the magnet. However, this theory is not to be taken as a limitation on the scope of the invention, which is defined only by the appended claims and their equivalents.

Comparing the cases of the single addition of glass, the single addition of graphite, and the combined addition of glass and graphite, as an internal lubricant, the magnetic properties of the magnet are "good," "better" and "best" respectively. The synergism accompanying the combined addition of proper amounts of graphite and glass has been found to provide the magnet with excellent magnetic properties.

Observations of the metallurgical microstructure of a magnet produced according to the present invention suggest that the flow of the grains of the magnetic particles is remarkably improved, with the grains becoming more uniformly oriented parallel to the die-upsetting direction because of the lubrication provided by the combined addition of glass and graphite. In addition to helping disperse the graphite material, the glass material component of the combination inner lubricant also contributes to improve the workability of the magnet in and of itself. Thus, the role played by the glass material as an inner lubricant in the present invention is different from the role of the glass material used as an outer lubricant of the previously described conventional processes for a hot-worked magnet.

Although the presence or nature of the chemical reaction between the low melting point glass powder and the graphite or powder is not clear at the present, it appear that a kind of catalysis is caused by the combined addition, although, again, this theory is not intended to be a limitation on the scope of the appended claims. We believe those "low melting point" glass materials having rather higher softening points provide the magnet with better magnetic characteristics and better workability. It is easy for a person skilled in the art to select such better glass materials on basis of the glass composition, the softening point and other teachings in the present disclosure, according to composition, shape and other factors of the magnet to be produced.

The graphite powder affects the residual magnetic flux density of the hot-worked magnet produced according to the present invention. However, graphite powder alone mixed with flakes of magnet material tends to reduce the iHc value of the magnet produced by hot-working. Moreover, plastic deformation of the grains in the magnet flakes tends to be hindered and even prevented because of the lumps produced as the graphite content increases.

As explained above, it is necessary to define the respective upper limits of the glass and graphite internal lubricant additives. It is necessary to adjust the amount of glass and the amount of graphite to obtain the preferable $O_2$ content and carbon content remaining in the magnet as explained below (for example, in Example 3). However, general observations of the metallurgical structure of the magnets produced according to the present invention teach the following. Although 0.3 wt % or less of glass material addition has some effect, 0.5 wt % of glass material addition causes a remarkable effect in regard to the more uniform arrangement of the grains and the orientation of the grains perpendicular to the die-upsetting direction. On the other hand, graphite is effective to make boundaries of the flakes clear as understood by an observation of the fracture plane of the magnets containing 0.1 wt % of glass material and various weights of graphite. Although the flake boundaries are difficult to observe in a magnet with 0.1 wt % of glass and no graphite, the flake boundaries become clearer according to the amount of graphite added to the magnet. The boundaries can be apparently observed in a magnet containing 0.1 wt % of glass and 0.3 wt % of graphite, and the boundaries are remarkably distinct in a magnet containing 0.1 wt % of glass and 0.5 wt % of graphite.

By observation of magnets containing 0.3 wt % of graphite and various weights of a glass material in a range of 0.1 wt % to 0.5 wt %, the following statement can be made. The flow shape of the rapid quench magnet material varies depending on the glass content, with the boundaries of the individual flakes being clearer in magnets containing graphite than in magnets having no graphite additive. The magnet containing 0.3 wt % of graphite and 0.3 wt % of glass is provided with a more uniform shape of flake-flow than ones having 0.3 wt % of graphite and 0.1 wt % of glass. However, some irregular flows which are not perpendicular to the die-upsetting direction are observed in a magnet containing 0.5 wt % of glass and 0.3 wt % of graphite.

The above stated observations of metallurgical structure of the magnets were conducted by an electron microscope. The examples are shown in FIGS. 6 and 7. FIG. 6 shows the microstructures of the fracture planes observed in a direction perpendicular to the hot compression direction. FIG. 7 shows the microstructures of the fracture planes observed in a direction parallel to the hot compression direction. The photomicrographs in the upper column are magnified by 2,000 times and the photomicrographs in the lower column are magnified by 30,000 times in FIGS. 6 and 7. A uniform microstructure is observed in the case of combined addition of 0.3 wt % glass material and 0.3 wt % graphite (case (b) in the figure), compared with the microstructure in the case of no additive (case (a) in the figure). As shown in case (c) in the figures, a combined addition of 0.3 wt % glass and 0.5 wt % graphite sometimes causes coarse grains to develop.

Figure 3:
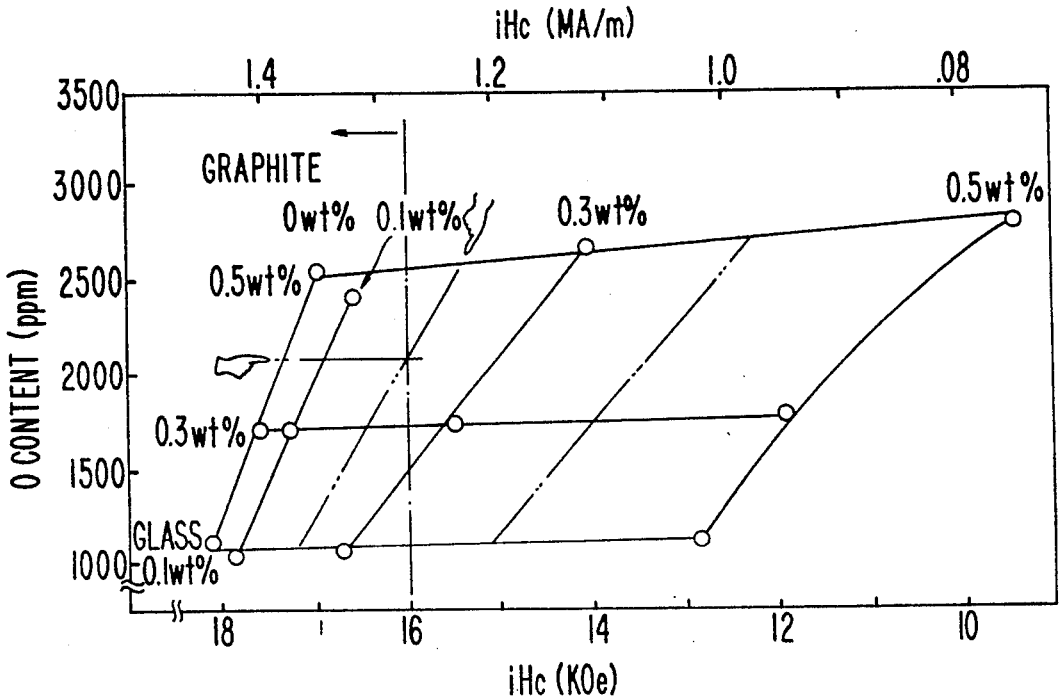
FIG. 3 shows the relation between coercive force and the amount of oxygen in a magnet wherein various amounts of glass and graphite are added as internal lubricants.

The excellent workability and also the excellent magnetic properties of a magnet according to the present invention are affected by the oxygen content and also the carbon content remaining in the magnet. FIG. 3 shows the residual carbon content and the residual oxygen content in a magnet containing glass material for various amounts of added graphite. It is believed that the slight increase of residual oxygen content according to the increase of the added graphite content is caused by absorption of water from the air during mixing of the flakes and the graphite. The residual carbon content increases linearly with the increase of added graphite and independently of the added glass content. The preferable carbon content and oxygen content remaining in a magnet are, respectively, 0.5 wt % or less and 0.3 wt % (300 ppm) or less in a magnet provided with good magnetic characteristics as taught by FIG. 4 and FIG. 3 which will be explained later in relation to Example 3.

The strain rate affects the magnetic characteristics of a magnet which is hot-worked according to the present invention. Although the external appearance of the formed magnet is not affected by a strain rate of about 0.5 to 0.1 mm/sec, the deformation resistance does depend on the strain rate even in the range of 0.5 to 0.1 mm/sec. This tendency is pronounced when the strain rate is relatively fast. The coercive force tends to decrease somewhat as the deformation rate is reduced. The residual magnetic flux density and the saturated magnetization are sensitive to the deformation rate. These properties decrease with an increase in the deformation rate and increase as the deformation rate is reduced. In particular, the rate of increase is enhanced in a case of deformation rate of 0.006 (1/sec) or less. As stated above, a magnet can be provided with a high saturated magnetization and a high residual magnetic flux density, resulting in a maximum energy product as high as 40 MGOe, without lowering the coercive force appreciably when it is hot-worked at a low strain rate.

For example, isothermal forging makes such a preferable hotworking step easy. The high degree of orientation of the grains which causes the magnetic anisotropy contributes to improve the magnetic characteristics significantly according to the present invention. The high degree of orientation of grain is observed by X-ray diffraction analysis.

It can be effective in the present invention to add as an inner lubricant component diethylene glycol and other organic lubricants in liquid form, described in patent application Ser. No. 07/327,631. Organic lubricants in liquid form are inferior to the dry powder additives disclosed in this specification because of the following problem. Segregation of oxygen and carbon would occur by virtue of the time lag of the vaporization of oxygen and carbon depending on the speed of heat transfer during the hot-compression process, particularly in cases of large hotworked magnets. In such cases the characteristics, especially the coercive force of the magnet, are not uniform in the magnet. It is a problem to produce industrially large hot-worked magnets using liquid lubricants. However, a proper amount of such liquid lubricants can be used in the present invention along with a glass material to produce magnets having excellent characteristics.

The upper limit of the average grain size in a magnet produced according to the present invention is about 1 μm, but a smaller grain size is preferable to provide the excellent magnetic characteristics. Preferably the average grain size in a magnet according to the present invention is about 0.5 μm. Also, it is difficult at the present time to manufacture a magnet having an average grain size of less than 0.2 μm because of the tendency of the powder to rapidly oxidize. A magnet having an average grain size of more than 1 μm suffers from a reduction in its coercive force.

An excess addition of graphite powder (about 0.5 wt % or more) can form gross grains distributed in the magnet. The determination of the average grain size can be accomplished by a "cut-method" of microphotography. The average grain size can be calculated by taking an average of about twenty or more values which are obtained using lines arbitrarily marked on the photomicrograph. Each line length is divided by the number of grain particle in that line length to obtain the value for that line, and the values are then averaged. It should be noted that the grain has a flat shape which is shorter in a direction parallel to the C-axis of the crystal and the above stated average grain size is measured in a plane perpendicular to the C-axis of the crystal. It is instructive to consider an average grain size (a) measured on a plane parallel to the C-axis of the crystal in addition to the average grain size (c) measured on a plane perpendicular to the C-axis. For example, (c) is about 0.2–0.3 μm, (a) is about 0.1 μm, giving an aspect ratio c/a of 2 or more, in cases where excellent characteristics of anisotropic bonded magnets are produced, as described in Japan patent application No. "Showa" 62-37378.

An excess addition of graphite (about 0.5 wt % or more) causes a severe reduction in the aspect ratio of a magnet produced according to the present invention. The excess graphite resulted in an excess amount of carbon remaining in the magnet of more than 0.5 wt% which reduced the magnetic properties of the magnet substantially. Also an excess amount of oxygen remaining in a magnet causes enhanced deformation resistance which, in turn, results in a severe reduction in the workability of the magnet. The magnet according to the present invention comprises as main components, a transition element designated "T", "R" a material selected from the rare earth elements and yttrium, and "B" boron. The compositions of the magnet are similar to the compositions disclosed in Japan Laid-Open patent application No. "Showa" 60-100402 which discloses known hot-worked magnets. In the present invention a transition metal element can be transition metal as Co, Ni, Ru, Rh, Pd, Os, Ir, Pt as a narrowly defined transition element and also an element having an atomic number of 21–29, 39–47, 72–79 and 89 or more as a broadly defined transition element.

Further, the addition of Ga is effective to enhance the magnetic properties of a hot-worked magnet produced by the present invention. See commonly assigned application Ser. No. 07/298,850 filed 1/19/89. "R" can be Nd, Pr as the main constituent, Ce or Didymium can be used to partially substitute for Nd or Pr, and Dy or Tb can be added to enhance thermal stability.

The present invention will be explained in further detail by the following Examples.

EXAMPLE 1

An alloy having the composition of 14.5 at % of Nd, 6 at % of B, 7.5 at % of Co, 0.75 at % of Ga and the balance Fe was produced by arc melting. This alloy melt was ejected onto a single roll rotating at a surface velocity of 30 m/sec in an Ar atmosphere to produce irregularly shaped thin flakes of about 30 μm in thickness. As a result of X-ray diffraction measurements, it was found that the thin flakes contained a mixture of amorphous phases and crystalline phases. The thin flakes were then pulverized to produce magnetic powder of 500 μm (32 mesh) or less in size and then spherically shaped particles were removed by a classifier. 150 grams of the separated particles was mixed with 0.2 wt % of graphite powder and 0.3 wt % of a low melting point glass material in a V-shaped mixer for ten minutes. The graphite was flake shaped and the glass material was $B_2O_3$-$Sio_2$-$Bi_2O_3$ type of amorphous glass. The characteristics of the above mentioned glass are shown in Table 1.

TABLE 1

| | |
|---|---|
| Coefficient of linear expansion | $72 \times 10^{-7}$ cm/cm. C.-deg. |
| Glass trans. temp. | 470 Celsius deg. |
| Yielding point | 502 Celsius deg. |
| Softening point | 550 Celsius deg. |

The mixture was pressed in a die under a pressure of 3 tons/cm$^2$ without applying a magnetic field, yielding green bodies having a density of 5.8 g/cm$^3$, a diameter of 28.5 and a height of 40.5 mm.

Each of the resulting green bodied was hot-pressed and subjected to die-upsetting at 740° C. and a compression ratio of 3.90 in a hot-working machine having a capacity of 30 tons to provide magnetic anisotropy.

The produced magnet samples were evaluated by various methods on the basis of test specimens each having a 0.5 mm×10.5 mm rectangular shape cut out from each sample. The following are the evaluation methods and apparatus therefor.

(A) Stress (Deformation Resistance)-Strain

Stress values were calculated at a strain value of $\epsilon=0.1$ on the basis that cracks would not be caused at this level of relative deformation during hot-working and die-upsetting process. press was used to provide a measured stress value $\sigma$ from about 40 MPa to about 250 MPa to generate a stress-strain curve from which the stress value $\sigma 0.1$ corresponding to a $\epsilon=0.1$ strain was determined. Workability in various conditions was compared on the basis of nominal values.

(B) Magnetic properties

Figure 5:
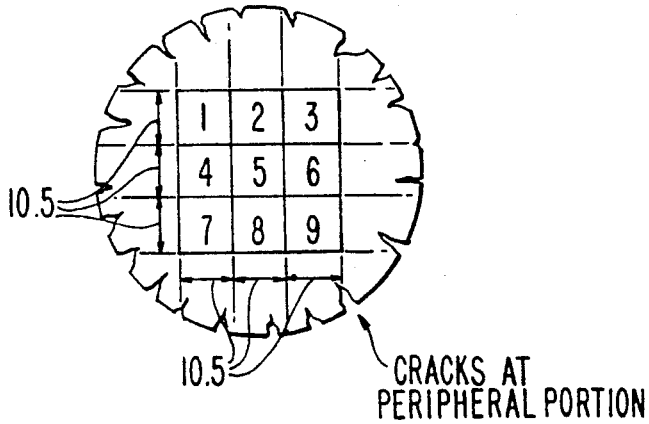
FIG. 5 shows a plane view of a conventional hot-worked magnet having cracks at the periphery.

A hysteresis loop in a second quadrant of the iHc v. $4\pi I$ curve was measured by a B-H tracer. A mean value was calculated as a representative value based on five samples which were cut out from a magnet. A layout of the cut portions used to obtain the samples and their dimensions are shown in FIG. 5 (depicting a prior art specimen which developed peripheral cracks), each sample having a 10.5 mm×10.5 mm rectangular shape. In FIG. 5 the numerals indicate the cut portions and the portions numbered as 1, 3, 5, 7, and 9 were actually used as samples. Observations by an optical microscope were conducted for the sample numbered 8.

(C) Additive Distribution

Measurements of the carbon content, oxygen content and glass content remaining in the hot-worked magnet were conducted on the basis of magnet powder produced by pulverizing the center portion of the sample magnet using concentration analyzers. The mean value of these measurements on each sample is the representative value of the content.

The distribution of glass was estimated on the basis of the distributions of the Si-element and the Bi-element which are contained in the low melting point of glass used in the experiment. The analysis of the Bi-element and the Si-element was conducted by an EPMA, measuring linearly the values in a plane oriented perpendicular to the die-upsetting direction.

(D) Composition

The observation of the microstructure was conducted on a surface direction, the surface being first ground with emery paper and mirror polished by buffing.

(E) Fracture plane

Observations of the fracture plane were conducted on the surface in a direction perpendicular to the die-upsetting direction after fracturing a hot-worked magnet, to investigate the flow of grains and grain growth intersecting the boundary of flakes produced by melt quenching. The composition analysis was conducted by SEM-EDX.

(F) Hardness

The hardness of the hot-worked samples cut out from a magnet were measured by a Micro-Vickers after mirror polishing the surface to be observed. The hardness was estimated on basis of a correlation table of hardness and the length of a diagonal line of a compressed mark formed by a compression pin made of diamond under a load of 1000 grams. The measurements were conducted on two surfaces parallel to the die-upsetting direction and two surfaces perpendicular to the die-upsetting direction. The mean of ten values measured on ten points comprising each five points in the two parallel planes is the representative value of the hardness in the respective direction. The evaluation results of the examples are as follows:

(A) Stress(Deformation Resistance)-Strain

The stress value was 0.48 (tons/cm$^2$) for the case of a strain rate of 0.1 (1/sec). It is understood that the deformation resistance decreases with a decrease in the strain rate.

(B) Magnetic properties $4\pi I_r=12.3$ (KG)

iHc=15.7 (KOe)

(BH)max=34.6 (MGOe)

were measured, indicating excellent permanent magnet characteristics.

(C) Carbon content, oxygen content; carbon distribution, glass distribution

Carbon content remaining=0.32 (wt%)

Oxygen content remaining=1700 (ppm)

By comparing a magnet using only graphite with a magnet including graphite and glass as internal lubricants, we confirmed that the graphite was more uniformly distributed in the latter magnet than in the former magnet. Glass is distributed uniformly in the magnet.

(D) Metallurgical Structure

A microstructure having a uniform composition flow was observed. The Vicker's hardness of the magnet was 650 Hv.

(E) Fracture Plane

The flow of flakes by the hot-working step was confirmed.

(F) Hardness

The hardness of the magnet made in accordance with the present invention was 650 Hv measured by Vicker's hardness test. The hardness of a magnet having no glass and no graphite was 580 Hv. Although the magnet according to the present invention is provided with a higher hardness, it does not become brittle. (Example for comparison)

Magnetic characteristics were measured on a magnet produced using only low melting point glasses for internal lubricant additives, that is, without graphite additives. The experimental results are shown in FIG. 1. The figure shows magnetic properties of a magnet vs. glass amount added to the magnet. As shown in the figure the residual magnetic flux density and the maximum energy product increase as the content of the glass additive increases. The peak value of the $4\pi I_r$ and (BH)max can be observed at a 0.3 wt % of glass amount. The $4\pi I_r$ value and the (BH)max value are, respectively, 320 G and 2 MGOe higher than the corresponding properties of a magnet having no additives. The intrinsic coercive force decreases only slightly as the glass amount increases, the iHc value remaining as high as 10900 Oe at the glass amount of 0.5 wt %.

EXAMPLE 2

Figure 2:
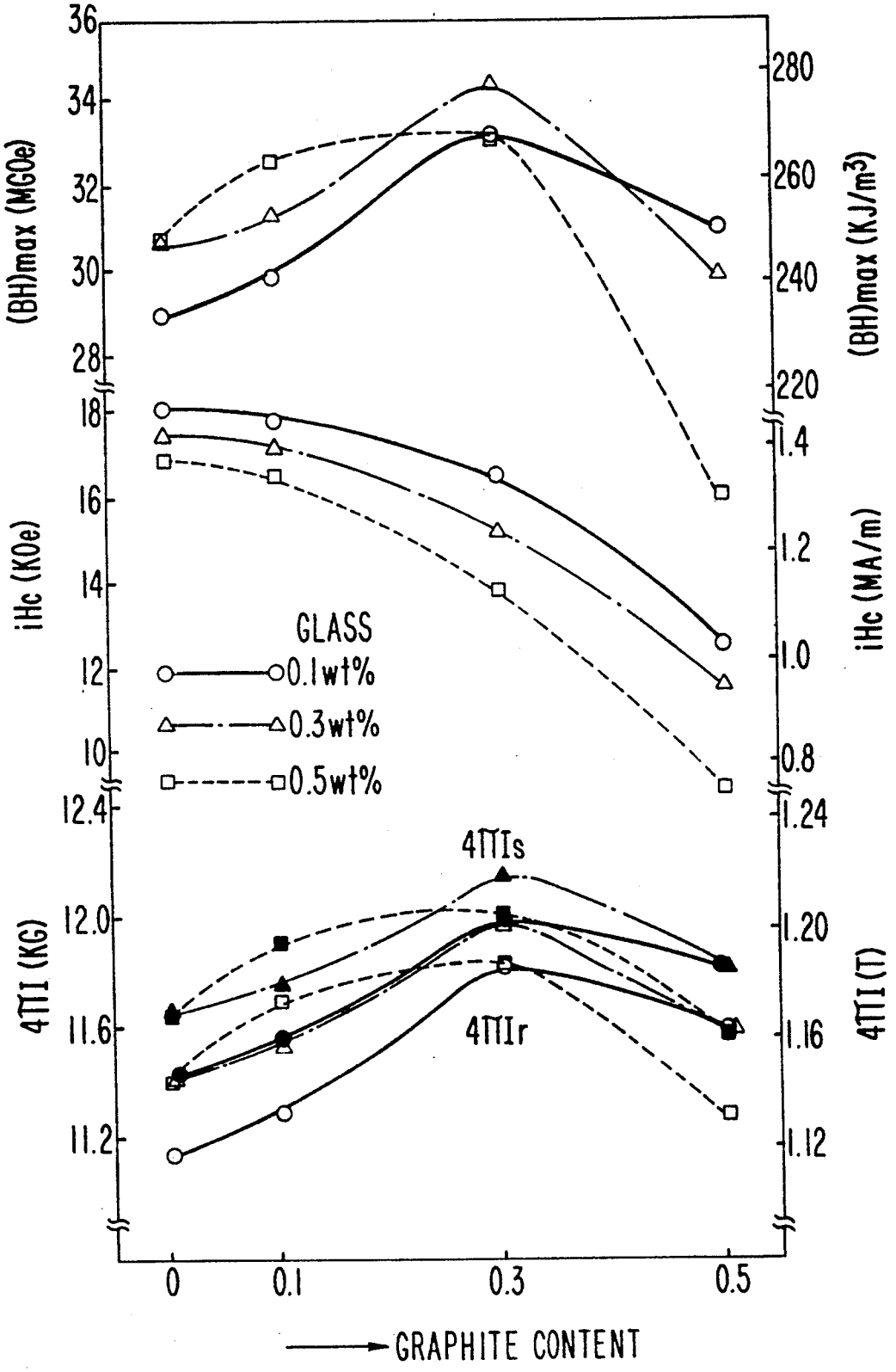
FIG. 2 shows magnetic properties such as $4\pi I$, iHc and (BH)max of a hot-worked magnet depending on the amounts of graphite and glass added in combination as internal lubricants.

Example 1 was repeated except that various amounts of graphite powder were used with various amounts of a low melting point glass material. With respect to each of the resulting magnetically anisotropic hot-worked magnets, magnetic properties were measured to evaluate the effects of the additives. In FIG. 2 the dependence of the magnetic characteristics on the glass amount are shown, measured at 0.1 wt %, 0.3 wt % and 0.5 wt % of glass amount, each with various amounts of graphite powder.

It is clear from FIG. 2 that as the amount of graphite increases, the residual magnetic flux density and the maximum energy product increase almost linearly at first, and that the maximum values of $4\pi I_r$ and (BH)max correspond to the 0.3 wt % of graphite in cases of 0.1 wt % glass additive and 0.3 wt % glass additive.

Among the magnetic properties, the $4\pi I_r$ value is improved by 910G, and (BH)max is improved by 5.9 MGOe as compared with the case of no additive when 0.3 wt% of graphite and 0.3 wt % of glass is added. When the amount of glass added was 0.5 wt %, the residual magnetic flux density rapidly increased with increasing amounts of added graphite, but remarkably decreased when graphite amounts reach about 0.5 wt %.

On the contrary the iHc value decreased rapidly as graphite content increases. The tendency for iHc to decrease is pronounced when the graphite additive and glass additive each were 0.5 wt %. The iHc value was 15430 Oe in case of 0.3 wt % glass and 0.3 wt % graphite, lower by about 2590 Oe compared with the case of no additive.

The amount of graphite powder is preferably less than 0.5 wt % because an iHc value of at least 10 KOe is necessary for a practical magnet having sufficient heat resistance. A maximum of (BH)max can be obtained with the addition of 0.3 wt % of graphite powder.

EXAMPLE 3

It is important to provide a preferable residual $O_2$ content and a preferable residual carbon content in the hot-worked magnet, in order to enhance the magnetic characteristics, not only to add the graphite powder and low melting point of glass as inner lubricants. In the same hot-working process as in Example 1, the residual oxygen content and residual carbon content were changed, in order to investigate the effects on iHc. The experiments were conducted on samples in which the content of graphite powder and content of glass material were changed. The experimental results are shown in FIG. 3.

Figure 4:
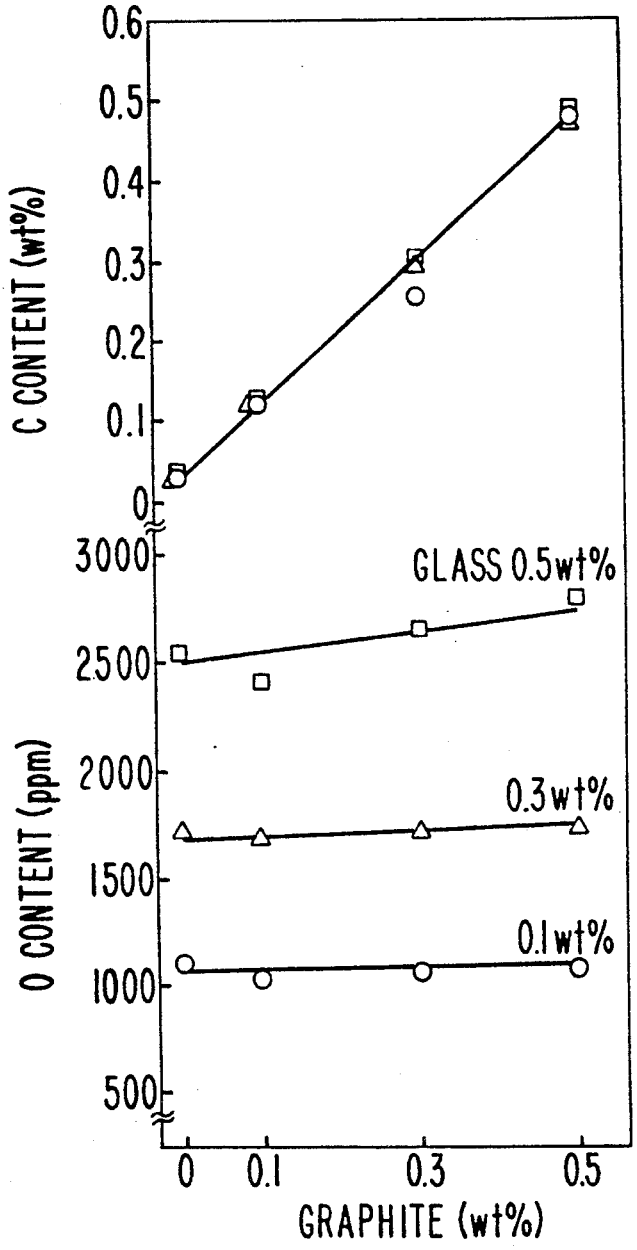
FIG. 4 is a graph showing the relations between the amount of graphite added, carbon content, and oxygen content, for various amounts of glass addition.

FIG. 4 shows correlations between the residual oxygen content, the residual carbon content and the amounts of graphite and glass added to the magnet. As the residual oxygen content does not strongly depend on the graphite content, the increase of oxygen content by graphite additive can be neglected, which is in contrast to the case of a complex additive of organic lubricant and glass. The residual carbon content is a strong function just of the graphite amount added. As stated above, the oxygen content is considered to depend only on the glass amount added.

The iHc value of a hot-worked magnet decreases as the graphite amount added or glass amount added increases. The tendency of iHc to decrease with increasing amounts of added graphite is not as pronounced in the case of concurrent glass addition as in case of the sole addition of graphite. Thus, it is important to consider the balance of oxygen and carbon even in case of combination additives as in the present invention. Simply stated, the decrease in iHc by carbon or oxygen can not be avoided because these elements react with the Nd component which is necessary to increase the coercive force. For example the maximum amount of glass additive is 0.4 wt % in a case that a coercive force of 16 KOe is necessary and the graphite amount is 0.2 wt %, according to the data in FIG. 3.

It will be apparent to those skilled in the art that various modifications and variations can be made in the above-described embodiments of the present invention without departing from the scope or spirit of the invention. Thus, it is intended that the present invention cover such modifications and variations provided they come within the scope of the appended claims and their equivalents.

What is claimed is:

1. Composition of matter for use in forming multi-grained hot-worked anisotropic magnets comprising:

R-T-B type alloy powder, wherein R is selected from the group consisting of the rare earth elements, yttrium, and mixtures thereof, T is a transition metal, and B is boron; and an internal lubricant comprising at least two additives homogenously distributed throughout said R-T-B alloy powder, said at least two additives including (a) a glass material, and (b) a carbon-based material.

2. The composition of matter as in claim 1, wherein said glass material is selected from the group consisting of $B_2O_3$-$SiO_2$-$Bi_2O_3$ glass and PbO-$SiO_2$-$B_2O_3$ glass.

3. The composition of matter as in claim 1 wherein said glass material is selected to have a melting point of less than about 650° C.

4. The composition of matter as in claim 3, wherein said glass material has a melting point of about 550° C.

5. The composition of matter as in claim 1, wherein said carbon-material is graphite.

6. The composition of matter as in claim 1, wherein said glass material is present in an amount of about 0.1 weight percent to about 0.3 weight percent.

7. The composition of matter as in claim 6, wherein about 0.3 weight percent of said glass material is present.

8. The composition of matter as in claim 1, wherein said carbon-material is present in an amount of about 0.1 weight percent to about 0.3 weight percent.

9. The composition of matter as in claim 8, wherein about 0.3 weight percent of carbon-material is present.

10. The composition of matter as in claim 7 wherein about 0.3 weight percent of carbon-material is present.

* * * * *